US005355542A

United States Patent [19]

Oreck et al.

[11] Patent Number: 5,355,542

[45] Date of Patent: Oct. 18, 1994

[54] ORBITER FLOOR MACHINE

[75] Inventors: Marshall B. Oreck; David I. Oreck, both of New Orleans, La.

[73] Assignee: Oreck Corporation, New Orleans, La.

[21] Appl. No.: 975,627

[22] Filed: Nov. 12, 1992

[51] Int. Cl.[5] ..... A47L 11/162

[52] U.S. Cl. ..... 15/49.1; 15/98

[58] Field of Search ..... 15/49.1, 50.1, 98; 51/170 MT, 174

[56] References Cited

U.S. PATENT DOCUMENTS

| | | | |
|---|---|---|---|
| 1,067,889 | 7/1913 | Trudeau | 15/49.1 |
| 1,688,580 | 10/1928 | Gernandt | 15/49.1 |
| 2,221,315 | 11/1940 | Okun | 15/49.1 |
| 2,367,668 | 1/1945 | Champayne | 51/170 MT |
| 2,706,875 | 4/1955 | Higley | 51/170 MT |
| 2,967,315 | 1/1961 | Helbig | 15/49.1 |
| 3,064,292 | 11/1962 | Fillery | 15/50.1 |
| 3,345,784 | 10/1967 | Stelljes | 51/170 MT |
| 3,416,177 | 12/1968 | Young | 15/98 |
| 3,793,776 | 2/1974 | Sadow | 51/170 MT |
| 4,183,112 | 1/1980 | Brown | 15/50.1 |
| 4,435,870 | 3/1984 | Tucker | 15/98 |
| 4,791,694 | 12/1988 | Itaya | 51/170 MT |

FOREIGN PATENT DOCUMENTS

| | | | |
|---|---|---|---|
| 373505 | 4/1923 | Fed. Rep. of Germany | 15/49.1 |
| 116274 | 4/1946 | Sweden | 15/49.1 |
| 1126284 | 11/1984 | U.S.S.R. | 15/49.1 |

*Primary Examiner*—David A. Scherbel
*Assistant Examiner*—Terrence R. Till
*Attorney, Agent, or Firm*—Seed and Berry

[57] ABSTRACT

An orbiter floor machine for treating floors, the floor machine having a top-hat-like housing with a handle extending upwardly toward a user. The floor machine includes a motor having a rotatable drive shaft extending therefrom, the drive shaft having a shaft axis. An annular flywheel has an axial opening that fixedly receives the drive shaft so that rotation of the drive shaft causes rotation of the flywheel. A bearing assembly has an eccentric aperture through which the drive shaft extends such that the bearing assembly has an axis that is radially spaced from the shaft axis. The bearing assembly is secured to the flywheel such that the rotation of the flywheel causing the bearing assembly to orbitally rotate such that the bearing axis orbits about the drive shaft axis. A counterbalance weight is secured to an outside perimeter of the flywheel in a position opposite to the bearing assembly axis with respect to the shaft axis. The forces caused by the orbiting motion of the weight acts to counterbalance the forces caused by the orbiting motion of the bearing assembly. A brush carrier is secured to the bearing assembly such that the brush carrier orbitally rotates with the bearing assembly. A brush ring is secured to the brush carrier to transmit the orbital rotation into an effective floor-scrubbing action. The weight of the non-rotating parts is made larger than the weight of the rotating parts to minimize the effect of the rotating parts being slightly out-of-balance. The location of the drive shaft within the bearing assembly permits the rotating parts to be located as close as possible to the surface to be treated such that force moments or out-of-balance conditions caused by engagement of the brush ring with the floor will not be transmitted in a significant manner to the handle of the machine.

10 Claims, 3 Drawing Sheets

ORBITER FLOOR MACHINE

DESCRIPTION

Technical Field

This invention relates to a floor-treating machine and, more particularly, to a floor polishing and carpet cleaning machine that provides rotational and orbital motion with vibration-free operation.

BACKGROUND OF THE INVENTION

Floor treating machines have been used for many years to polish floors and/or clean carpets. Such machines typically include a top-hat-like hollow housing with an elongated handle angled upwardly toward a user. Attached to the housing is a motor having a rotatable drive shaft that extends through the housing and is connected to a circular brush ring. The brush ring may include cleaning bristles, coarse or smooth pads, or any other surface for cleaning or polishing depending on the type of floor to be cleaned or polished.

In these prior art machines, the motor drive shaft is coaxially connected to the brush ring. When the motor rotates the drive shaft, the coaxial connection causes the brush ring to rotate identically with the shaft. While this rotational motion adequately polishes floors, a back-and-forth scrubbing motion is more effective for cleaning. When using the prior art machines, the user must manually move the entire machine back and forth to create the desired scrubbing motion. Such manual motion takes much effort and still inadequately cleans because of the inability of a user to manually move the machine back and forth fast enough to thoroughly clean the floor.

To overcome some of the disadvantages of these prior art machines, the assignee of the present invention previously developed and sold a small ten-inch diameter floor machine that provides an orbital motion to its brush ring. In that machine, the motor was mounted directly on the machine housing with a drive shaft extending through the housing. A bearing assembly was eccentrically mounted on the drive shaft such that the bearing assembly rotated and moved orbitally about the motor shaft. A brush ring carrier was attached to the bearing assembly by screws to translate the rotational and orbital motion to the brush ring. A series of small, flat washers, each having a radial side more heavily weighted that its opposite side, were placed between the bearing assembly and the motor to counterbalance the orbital motion of the brush ring caused by the eccentric mounting of the bearing assembly.

The design of the previous orbiter floor machine sold by the assignee of the present invention worked adequately for a small 10-inch machine, but the design could not be used for larger machines such as the 17-, 20-, and 24-inch machines commonly available (size refers to the diameter of the brush ring used). In such larger machines, the small washers of the small machine could not sufficiently counterbalance the force caused by the orbital motion. Such washers have a substantial portion of their weight centrally located such that the weight of the washers needed to counterbalance the increased radius of the brush tings of the larger machines is much greater that would be the case for a counterbalance weight located further from the shaft. If more washers are added to provide the necessary counterbalancing weight, the counterbalancing forces will act on a plane at a substantial distance from the forces at the brush ring that are intended to be counterbalance. As a result, the system becomes out-of-balance and unstable with vibrations being transmitted to the user.

OBJECTS AND SUMMARY OF THE INVENTION

A general object of the invention is to correct or substantially alleviate the problems described above.

A more specific object of the present invention is to provide a floor-treating machine which is virtually vibration free in various types of operating environments.

Another object of the invention is to provide a floor-treating machine in which an orbital action is imparted to a brush ring and wherein the orbitally moving parts are of relatively light weight.

A further object of the invention is to provide a floor-treating machine in which the orbitally moving parts are counterbalanced for smooth, effective operation.

A still further object of the invention is to provide a floor-treating machine in which the mass and weight of the non-rotating parts is so related to the mass and weight of the driven moving parts that the machine is easily maneuverable and performs effective work on a variety of different types of surfaces to be cleaned.

Another object of the invention is to provide a floor-treating machine wherein a compact low or close to work surface arrangement of a counterbalance weight and a brush carrier is provided, wherein the parts to counterbalance are of relatively fight weight, and wherein the brush carrier encloses and protects a bearing assembly which freely rotatably mounts the brush carrier in eccentric relation to a motor drive shaft axis.

The present invention is directed to a floor-treating machine for use as a floor polishing machine as well as a carpet cleaning machine wherein disadvantages of the prior devices are obviated or minimized. The weight relationship of the several component parts is so arranged that the machine will be virtually vibration free and not noticeably out of balance regardless of the type of surface on which it is employed. Moreover, the machine has orbitally moving parts of relatively light weight in which a minimum number of parts are employed.

DETAILED DESCRIPTION OF THE INVENTION

Figure 1:
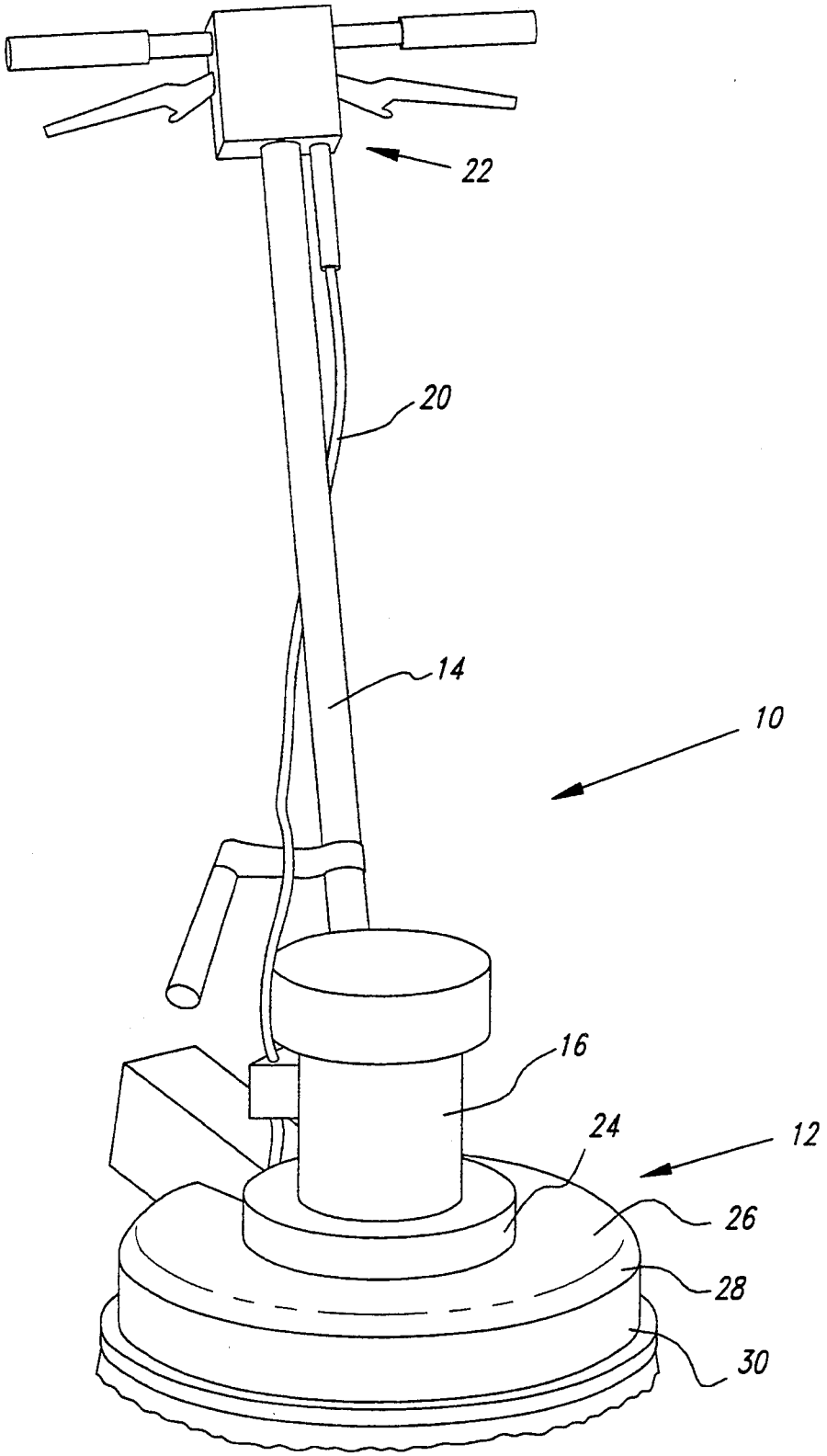
FIG. 1 is a perspective view of a orbital floor machine according to the present invention.

As shown in FIG. 1, a floor-treating machine 10 of the present invention includes a hollow housing 12 and a handle 14 pivotally connected to the housing. The handle is adjustably positionable and carries suitable controls for the floor-treating machine in a well-known manner. The housing is attached to and supports a motor 16 from which may be supported a brush ring 18 for orbital motion about an axis of the motor, as hereinafter more particularly described in conjunction with FIGS. 2 and 3. The motor 16 is suitably connected by an electric cord 20 to a controller 22 on the handle 14 and to a source of electric power for operation. It will be understood, that the floor-treating machine of FIG. 1 can be equipped with different types of brush rings depending upon the surface to be treated. Such surfaces include various types of floor coverings such as linoleum, tile, rubber, plastic, wood, as well as carpet, rug or other like surfaces.

Figure 2:
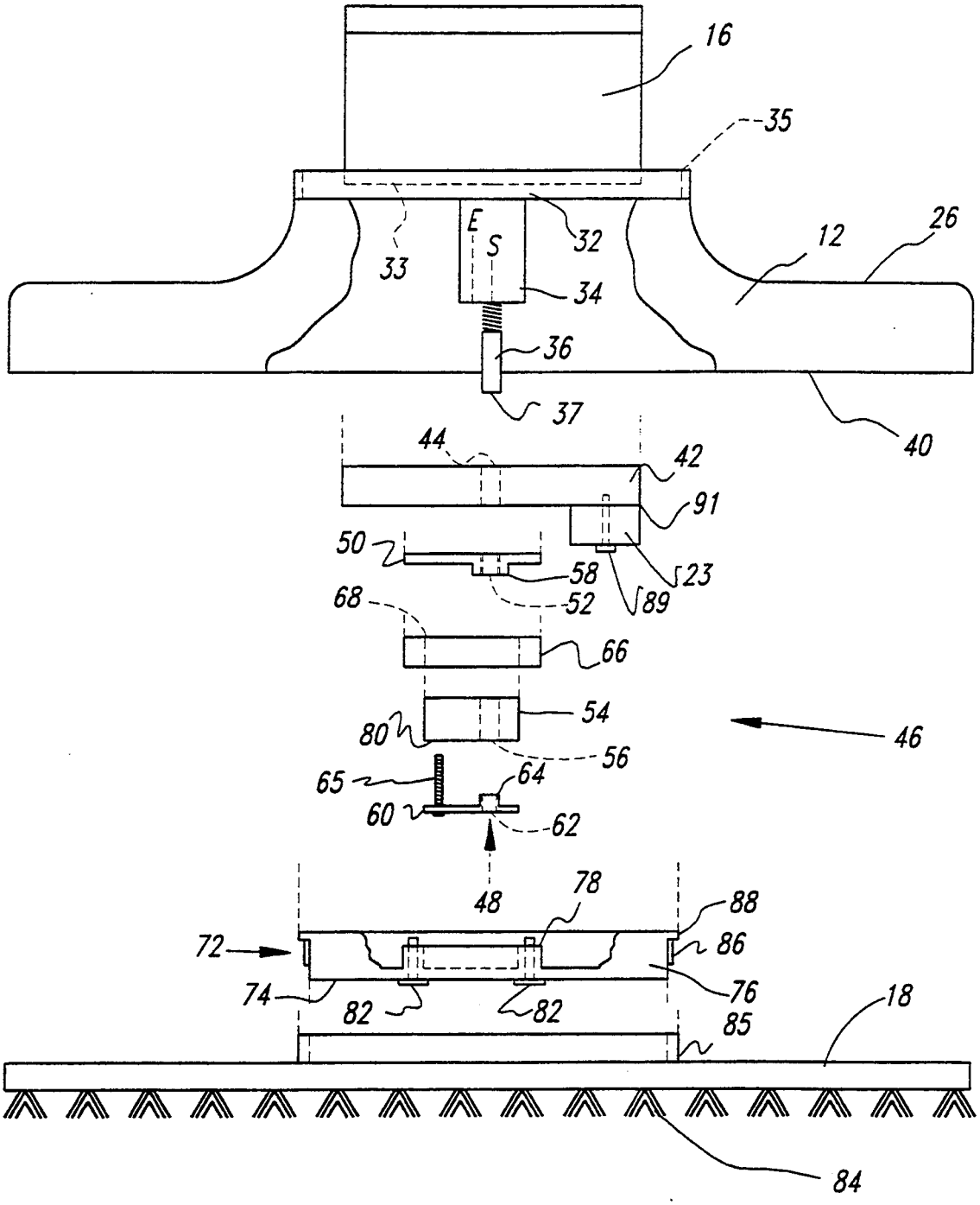
FIG. 2 is an exploded elevational view of a drive assembly used with the orbital floor machine of FIG. 1.

The present invention is particularly directed to the manner in which the brush ring 18 is supported from the motor 16 and is actuated thereby. As shown in FIG. 2, the brush ring has an axis E that is offset from the axis S of the motor such that the motor rotation causes the brush ring to move orbitally as well as rotationally. This orbital motion provides a scrubbing action to the brush ring for more effective cleaning and polishing. A counterbalance weight 23 is positioned along a plane that is close to the center of gravity of the brush ring to counterbalance the orbital motion of the brush ring without causing instability of the system. Further, the weight of the non-rotating parts is made much larger than the weight of the rotating parts to minimize the effect of the rotating parts being slightly out-of-balance.

The housing 12 is preferably relatively heavy and may be made of a metal that is capable of being molded and cast. As shown in FIG. 1, the housing 12 is of top-hat-like configuration and includes an open bonnet portion 24 smoothly merging with an outwardly and downwardly directed flange portion 26. The flange portion has a peripheral downwardly extending wall section 28 upon which may be mounted in suitable manner a protective vinyl-like gasket 30.

As shown in FIG. 2, the motor 16 is securely mounted to a motor mount bracket 32 which is affixed to the housing 12. The motor mount bracket includes a circular recessed portion 33 into which the motor fits to assist in the lateral retainment of the motor. The motor mount bracket has a hollow cylindrical member 34 extending from a central portion of the motor mount bracket through an upper opening 35 in the housing 12. The motor 16 may be any suitable low horsepower motor having desired characteristics and adapted to be positioned with the axis of the motor in a vertical position. The motor 16 includes a rotatable drive shaft 36 that extends through the bracket cylindrical member 34, the drive shaft having an axis coincident with the axis of the motor. One or more bushings (not shown) may be positioned within the bracket cylindrical member 34 to allow smooth rotation of the drive shaft within the bushings and the bracket cylindrical member. The drive shaft has an end 37 that preferably extends below the plane of a lower opening 38 as defined by a bottom edge 40 of the housing wall section 28.

An annular flywheel 42 having a central aperture 44 is affixed on the drive shaft 36 by suitable means such as interconnecting threads. A bearing assembly 46 having an eccentric aperture 48 is secured to the flywheel such that the bearing assembly has a central axis E that is laterally spaced from the shaft axis S. A result of this spaced relationship is that the rotation of the drive shaft and flywheel causes a rotational and orbital motion in the bearing assembly. The orbital motion is characterized by the bearing assembly axis E orbiting about the shaft axis S.

The bearing assembly 46 includes a spacer 50 having an eccentric aperture 52 that forms part of the eccentric bearing assembly aperture 48 through which the drive shaft 36 extends. Coupled to the spacer 50 is a cylindrical bearing 54 having an eccentric aperture 56 in alignment with the eccentric aperture 52 of the spacer 50. The spacer has a circular lip 58 extending from its aperture 52 into the bearing aperture 56 to restrict lateral movement of the bearing with respect to the spacer. The bearing assembly 46 includes a bearing plug 60 having an eccentric aperture 62 aligned with the drive shaft 36. The spacer aperture 52, bearing aperture 56, and bearing plug aperture 62 together form the eccentric bearing assembly aperture 44. The bearing plug 60 has a circular lip 64 that extends from its aperture 62 into the bearing aperture 56 at an end opposite the spacer lip 58, the plug lip 64 acting to restrict lateral movement of the bearing with respect to the bearing plug 60. A pair of screws 65 extend through the bearing plug 60, bearing 54, and spacer 50 and into the flywheel 42 so that the flywheel rotation causes the bearing assembly 46 to rotate. The use of an eccentric bearing assembly aperture 44 causes orbital movement in that the bearing assembly axis E orbits about the drive shaft axis S.

The bearing assembly 46 includes a bearing retainer 66 having an aperture 68 that mates with an upper end 70 of the bearing 54. Because the bearing 54 moves orbitally as well as rotationally, the bearing retainer 66 moves with the bearing 54 without a fixed connection between them. As a result, the bearing retainer moves rotationally and orbitally about the drive shaft 36.

The floor treating machine 10 includes a light-weight brush carrier 72 having a circular bottom wall 74 with an integral peripheral wall 76 extending upwardly from the perimeter of the bottom wall. Extending upwardly from a central area of the bottom wall 74 is an annular boss 78 sized to mate with a lower end 80 of the bearing 54. The annular boss 78 is affixed to the bearing retainer 66 such as by a plurality of screws 82. The boss/bearing retainer connection allows the brush carrier 72 to move with the bearing retainer 66 rotationally and orbitally about the drive shaft 36. The brush carrier is preferably made of a lightweight plastic material, such as Zytel.

Coupled to the brush carrier 72 is the brush ring 18 that treats a floor using the above-described orbital and rotational motions. The brush ring 18 is an annular body of suitable well-known material and preferably carries a plurality of circularly-arranged tops of brush bristles 84 of suitable synthetic or natural fiber material. The brush ring 18 includes an annular lip 85 that is retained on the brush carrier 72 by a plurality of circumferentially spaced, vertically extending embossments or ridges extending downwardly from a lip 88 on the brush carrier 72. The brush ring annular lip is pressed onto the peripheral wall 76 of the brush carrier and is frictionally held thereon by the spaced ridges 86.

Figure 3:
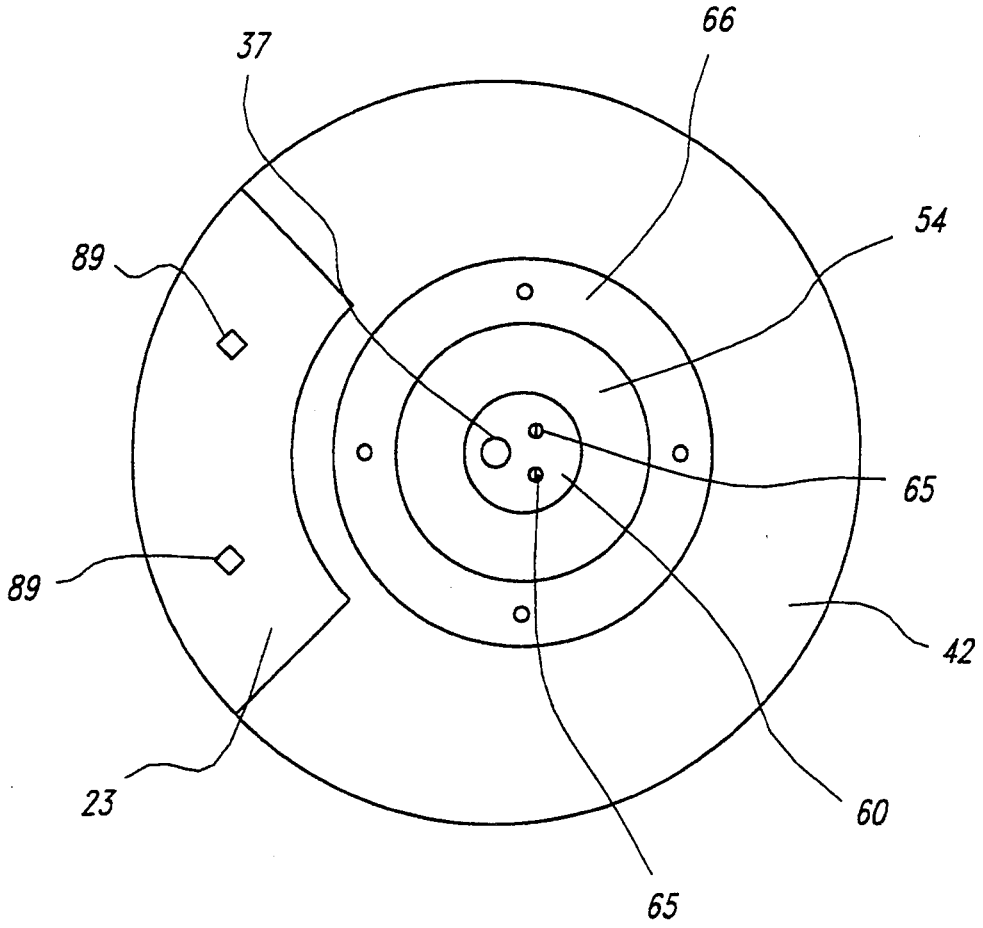
FIG. 3 is a bottom elevational view of a flywheel and bearing assembly of the drive assembly of FIG. 2.

To compensate for the orbital motion of the bearing assembly 46, brush carrier 72, and brush ring 18, the counterbalance weight 23 is affixed to the flywheel 42 by appropriate means, such as screws 89. The counterbalance weight is fixed to the bottom of the flywheel in a radial plane substantially equal to the radial plane of the bearing retainer 66. In a preferred embodiment, the flywheel 42 is a three-eighths inch thick steel plate with a six and three-sixteenth inch diameter, the weight is three-eighths inch thick and weighs 15.7 ounces, and the bearing assembly axis E is offset from the drive shaft axis S by eleven-thirty seconds of an inch. Preferably the counterbalance weight 23 is crescent-shaped and has an inner arcuate surface 90 having a radius larger than the radius of the bearing retainer 66 as shown in FIG. 3. The counterbalance weight is placed along the outside perimeter 91 of the flywheel in position opposite to the eccentric bearing axis E with respect to the shaft axis S. The counterbalance weight may consist of a single member as shown in FIGS. 2–3 or a plurality of members whose combined weight and positioning are equivalent to the weight and position of a single counterbalance weight member.

It is important to note that the location of the drive shaft end 37 within the bearing plug 60 and the bearing 54, permits the rotating parts to be located as close as possible to the surface to be treated and virtually within the height defined by the brush ring 18. The shaft end 37, bearing 54, counterweight 23, and brush ring annular lip 85 are each located at or near the plane of the bottom edge 40 of the housing 12. Thus, the combined center of gravity of the relatively heavy metal mass of housing 12 and motor 16 is brought into relatively close spaced vertical relation to the center of gravity of the moving parts of the machine. Since such moving parts are supported relatively close to the floor being treated, it will be readily apparent that force moments or out-of-balance conditions caused by engagement of the bristles with the floor, will not be transmitted in a significant manner to the handle of the machine.

Since the weight of the stationary parts is relatively great as compared to the weight of the moving parts, and since the flywheel 42 provides inertial stability to the parts directly driven by the shaft 36, the effect of engagement of the bristles with a surface being treated will be minimized. Thus, while some out-of-balance conditions may exist during operation of the machine, the effect of the out-of-balance conditions will be overcome by the relatively heavy, stable mass and such conditions will be insignificant and not noticeable to an operator. Since the weight of the machine is relatively heavy, when compared to the orbital moving parts, the machine provides a very stable machine for polishing floors made of tile, including plastic, rubber and asphalt material.

It should be noted that the brush carrier 72 provides an enclosure including the solid bottom wall 74 which covers and protects the shaft end 37, bearing 54 and flywheel 42. Thus, when the machine is used with water, which may include detergents and other cleansing solutions, these parts will remain unaffected and normally untouched by such solutions.

It will be understood that on a smooth, hard-surfaced floor such as linoleum, tile or the like, a longer bristle brush may be used and that the brush bristles support the weight of the machine. In such instance, there is relatively little resistance between the floor and the bristles, and starting load conditions for the machine are substantially less and different that those on a carpet.

From the foregoing it will be appreciated that, although specific embodiments of the invention have been described herein for purposes of illustration, various modifications may be made without deviating from the spirit and scope of the invention. Accordingly, the invention is not limited except as by the appended claims.

We claim:

1. An orbiter floor machine for treating floors, comprising:

a motor having a rotatable drive shaft extending therefrom, the drive shaft having a shaft axis;

an annular flywheel having an axial opening for fixedly receiving the drive shaft so that rotation of the drive shaft causes rotation of the flywheel;

a bearing assembly having an eccentric aperture through which the drive shaft extends such that the bearing assembly has an axis that is spaced from the shaft axis, the bearing assembly being secured to the flywheel, the rotation of the flywheel causing the bearing assembly to orbitally rotate such that the bearing axis orbits about the drive shaft axis;

a counterbalance weight secured to a peripheral margin of the flywheel in a position opposite to the bearing assembly axis with respect to the shaft axis;

a brush carrier secured to the bearing assembly such that the brush carrier orbitally rotates with the bearing assembly;

a housing having a downwardly and outwardly extending flange terminating in a lower edge; and a motor mount to which the motor is affixed, the motor mount being affixed to the housing, the motor mount having a cylindrical member extending axially away from the motor, the drive shaft extending coaxially through the cylindrical member, the cylindrical member having a radius larger than a radius of the bearing assembly eccentric aperture, thereby preventing the bearing assembly from sliding onto the cylindrical member, the cylindrical member having a length that causes the bearing assembly to be positioned in the same radial plane as the housing lower edge.

2. The orbiter floor machine of claim 1 wherein the counterbalance weight is crescent-shaped.

3. The orbiter floor machine of claim 1 wherein the counterweight is radially coplanar with the bearing assembly.

4. The orbiter floor machine of claim 1, further including a handle extending upwardly from the housing, the motor, housing, and handle being made of materials and sized to provide a combined mass greater than the combined mass of the rotating items such that the transmission of any vibrations caused by the rotating items to a user operating the handle will be minimized.

5. The orbiter floor machine of claim 4 wherein the counterweight is radially coplanar with the bearing assembly.

6. The orbiter floor machine of claim 1 wherein the bearing assembly includes an annular bearing retainer and a cylindrical bearing, and the brush carrier including an annular boss extending toward the motor, the bearing having a first end positioned within the bearing retainer and a second end positioned with the annular boss, the annular boss being affixed to the bearing retainer.

7. An orbiter floor machine for treating floors, comprising:

a motor having a rotatable drive shaft extending therefrom, the drive shaft having a shaft axis;

a flywheel having an axial opening for fixedly receiving the drive shaft so that rotation of the drive causes rotation of the flywheel;

a bearing assembly having an eccentric aperture through which the drive shaft extends such that the bearing assembly has an axis that is radially spaced from the shaft axis, the bearing assembly being secured to the flywheel, the rotation of the flywheel causing the bearing assembly to orbitally rotate such that the bearing axis orbits about the drive shaft axis; and a counterbalance weight secured to the flywheel in a position opposite to the bearing assembly axis with respect to the shaft axis, the counterbalance weight being radially coplanar with the bearing assembly;

a housing having a downwardly and outwardly extending flange terminating in a lower edge; and a motor mount to which the motor is affixed, the motor mount being affixed to the housing, the motor mount having a cylindrical member extending axially away from the motor, the drive shaft extending coaxially through the cylindrical member, the cylindrical member having a radius larger than a radius of the bearing assembly eccentric aperture, thereby preventing the bearing assembly from sliding onto the cylindrical member, the cylindrical member having a length that causes the bearing assembly to be positioned in the same radial plane as the housing lower edge.

8. The orbiter floor machine of claim 7 wherein the counterbalance weight is crescent-shaped.

9. The orbiter floor machine of claim 7, further including a handle extending upwardly from the housing, the motor, housing, and handle being made of materials and sized to provide a combined mass greater than the combined mass of the rotating items such that the transmission of any vibrations caused by the rotating items to a user operating the handle will be minimized.

10. The orbiter floor machine of claim 7, further including a brush carrier secured to the bearing assembly such that the brush carrier orbitally rotates with the bearing assembly and wherein the bearing assembly includes an annular bearing retainer and a cylindrical bearing, and the brush carrier including an annular boss extending toward the motor, the bearing having a first end positioned within the bearing retainer and a second end positioned with the annular boss, the annular boss being affixed to the bearing retainer.

* * * * *

UNITED STATES PATENT AND TRADEMARK OFFICE

CERTIFICATE OF CORRECTION

PATENT NO. : 5,355,542

DATED : October 18, 1994

INVENTOR(S) : Marshall B. Oreck and David I. Oreck

It is certified that error appears in the above-identified patent and that said Letters Patent is hereby corrected as shown below:

In column 6, claim 7, lines 55 and 56, after "drive" and before "causes", please insert --shaft--

Signed and Sealed this

Twenty-first Day of February, 1995

*Attest:*

Bruce Lehman

BRUCE LEHMAN

*Attesting Officer*

*Commissioner of Patents and Trademarks*